United States Patent [19]

Mackal

[11] Patent Number: 4,498,604

[45] Date of Patent: Feb. 12, 1985

[54] AUTOMATIC INFLATOR

[76] Inventor: Glenn H. Mackal, 4923 59 Ave. S., St. Petersburg, Fla. 33702

[21] Appl. No.: 401,652

[22] Filed: Jul. 26, 1982

[51] Int. Cl.[3] ..... B67B 7/24

[52] U.S. Cl. ..... 222/5; 222/54; 441/95; 141/329

[58] Field of Search ..... 222/5, 54, 81, 83, 83.5, 222/131, 162, 543, 3; 441/41, 93, 95, 92; 141/19, 10, 114, 313, 329, 330

[56] References Cited

U.S. PATENT DOCUMENTS

| | | | |
|---|---|---|---|
| 2,574,028 | 11/1951 | Fields et al. | 222/5 |
| 2,786,599 | 3/1957 | Higbee | 222/54 |
| 3,032,788 | 5/1962 | Lowther, Jr. | 441/93 |
| 4,223,805 | 9/1980 | Mackal | 222/5 |
| 4,260,075 | 4/1981 | Mackal | 222/5 |
| 4,267,944 | 5/1981 | Mackal | 222/5 |

*Primary Examiner*—Stanley H. Tollberg
*Assistant Examiner*—Kevin P. Shaver

[57] ABSTRACT

An automatic inflator which inflates gas-inflatable articles by the release of compressed gas from a gas-containing capsule by the piercing of a seal on the capsule. The inflator has an elongated housing having first and second end portions, the housing receiving a compressed gas-containing capsule for longitudinal movement with respect thereto and with the seal on the capsule disposed adjacent the second end portion of the housing. A piercing pin is mounted on the second end portion of the housing to confront the seal of a capsule mounted therein, there being a spring at the first end portion of the housing for constantly urging the capsule longitudinally of the housing toward the second end portion thereof. A releasable blocking device is disposed adjacent the second end portion of the housing and interposed between the seal containing end of the capsule and said second end portion of the housing to hold the seal of the capsule spaced from the piercing pin, the blocking device including a water-sensitive member which when wet releases the blocking device so that the spring moves the capsule toward the piercing pin so that the seal of the capsule is pierced thereby. The inflator is also provided with a selectively withdrawable abutment for the blocking device, whereby the capsule seal may be pierced manually.

11 Claims, 7 Drawing Figures

AUTOMATIC INFLATOR

This invention is related to those of the same inventor which are disclosed in U.S. Pat. Nos. 4,223,805, Sept. 23, 1980; 4,260,075, Apr. 7, 1981; and 4,267,944, May 19, 1981.

This invention relates to an automatic inflator for inflatable articles such as life rafts, life vests, and the like. In the disclosed preferred embodiment thereof, the inflator is capable of operation both manually and automatically, the inflator in the latter mode of operation being operated automatically upon its subjection to water, as by being submerged therein when employed with a life vest worn by a ditching or parachuting aviator.

Automatic inflators have been previously proposed. Among such prior disclosed automatic inflators are the following: Muller, U.S. Pat. No. 1,329,990, Spidy, U.S. Pat. No. 2,894,658, Waters, U.S. Pat. No. 3,242,514, Fujimoto, U.S. Pat. No. 3,494,506, and Niemann, U.S. Pat. No. 3,997,079. Of these patents, only those to Fujimoto and Niemann disclose automatic inflators which are also capable of operation manually. In Fujimoto a level-operated cam, an automatic, water-responsive mechanism, and a gas capsule which is moved toward a stationary piercing pin are arranged in that order. The operation of the inflator manually by the lever-operated cam may well cause operation of the automatic inflator portion of the device, a result which is neither necessary nor desirable. In Niemann, although the automatically operating portion of the device is disposed in series in that order with the manually operating portion thereof and the piercing pin, a part of the automatically operating mechanism is disposed in a first, removable part of the housing and another part of the automatically operating mechanism is disposed in a second part of the housing, and remains therein when the first part of the housing is removed and the inflator is operated only manually. Further, the removal of the first housing part leaves the second housing part in open condition, vulnerable to its being fouled both by physical and atmospheric agencies.

The above three referred-to Mackal patents have overcome to a substantial extent the outlined disadvantages of the prior art, and have provided an automatically operated mechanism, responsive to being immersed in water, to effect a piercing of a gas-containing capsule, which may be easily attached to and held securely as a part of a manually operable inflator which by itself is complete. The inflator of the present invention represents an improvement, not only over the above-noted prior art of others, but also over the invention of the prior Mackal patents. The inflator of the present invention is of simpler, more compact construction than prior inflators, is more economically made, and is more simply manipulated when operated in its manual mode. The gas-containing capsule is mounted within a housing, and thus is protected from the atmosphere. The moisture-responsive latching mechanism which makes the automatic operation of the inflator possible is readlily replaceable; the inflator has a positive $CO_2$ seal; and the fact that the inflator has been manually operated is readily ascertainable from the fact that the manually firing mechanism, in the nature of an insertable fork, will have been removed from the inflator. Finally, the inflator of the invention has an indicator means which permits the fact that the inflator has been automatically operated to be quickly and accurately ascertained.

The invention will be more readily understood upon consideration of the accompanying drawings, in which.

Figure 1:
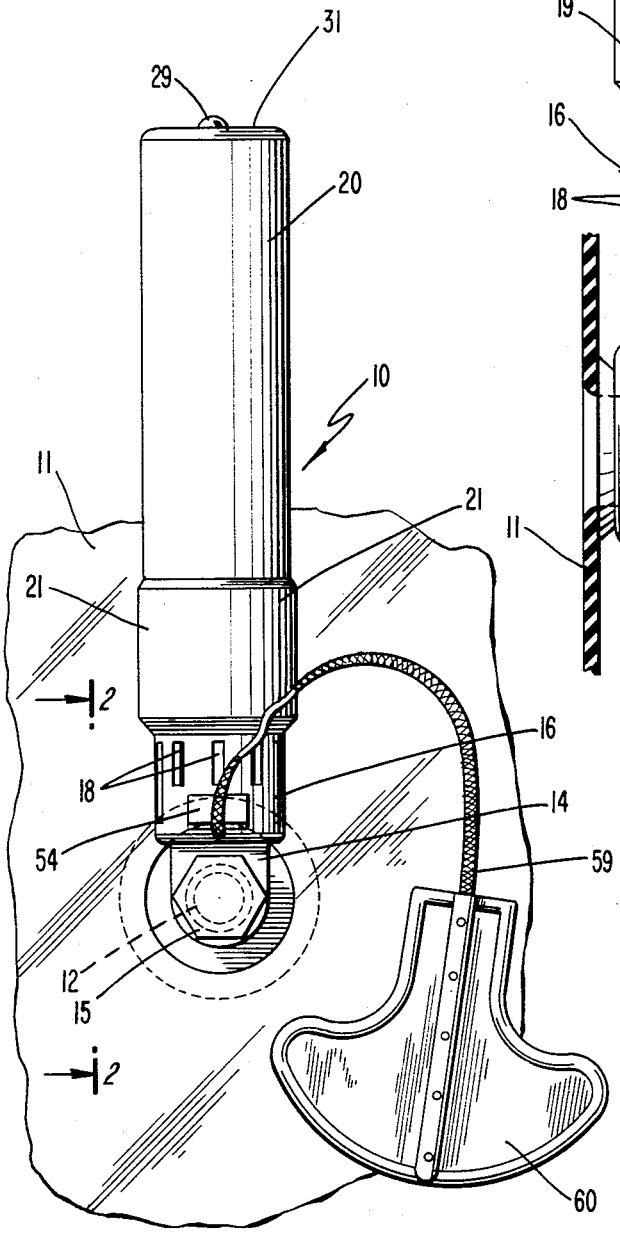
FIG. 1 is a view in side elevation of a preferred embodiment of the automatic inflator of the invention, such inflator being shown attached to a portion of the wall of an inflatable article.
Figure 2:
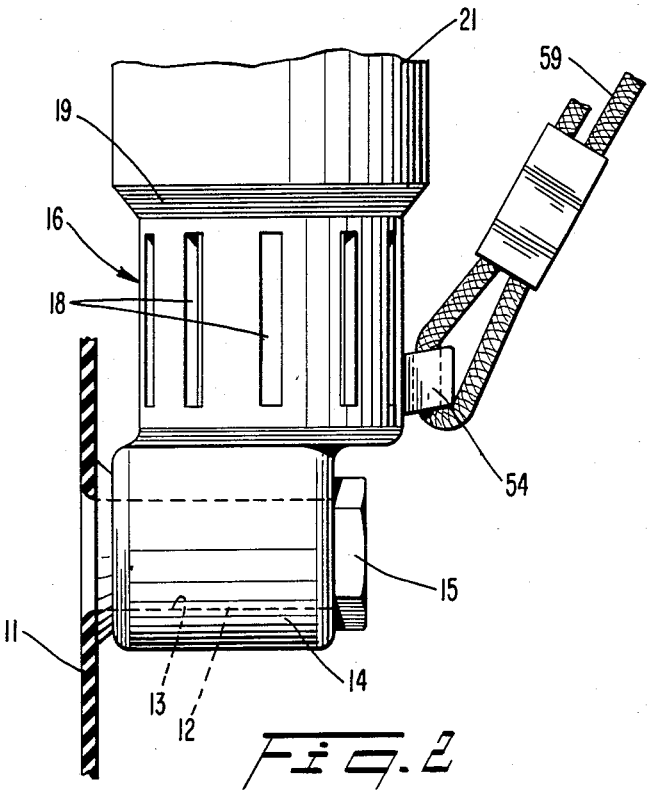
FIG. 2 is a fragmentary view on an enlarged scale of the inflator of FIG. 1, the view being taken generally from the line 2—2 in FIG. 1.

FIGS. 1 and 2 show a preferred embodiment of inflator 10 in accordance with the invention, the inflator being attached and sealed to the side wall 11 of an inflatable article by way of a stem 12 which is received in a bore 13 in a fitting 14 which forms a part of the body of the inflator. The stem 12 is secured and sealed to the fitting 14 by means including a cap nut 15. The fitting 14 forms a part of a body member 16 which is one of the two main parts of the housing of the inflator. As shown in FIGS. 3-6, incl., the body 16 has an externally threaded rear (right) end portion 17 the forward end of which terminates at an annular shoulder 19. A plurality of openings 18 through the wall of body member 16 allows the passage of water into the interior thereof.

Figure 3:
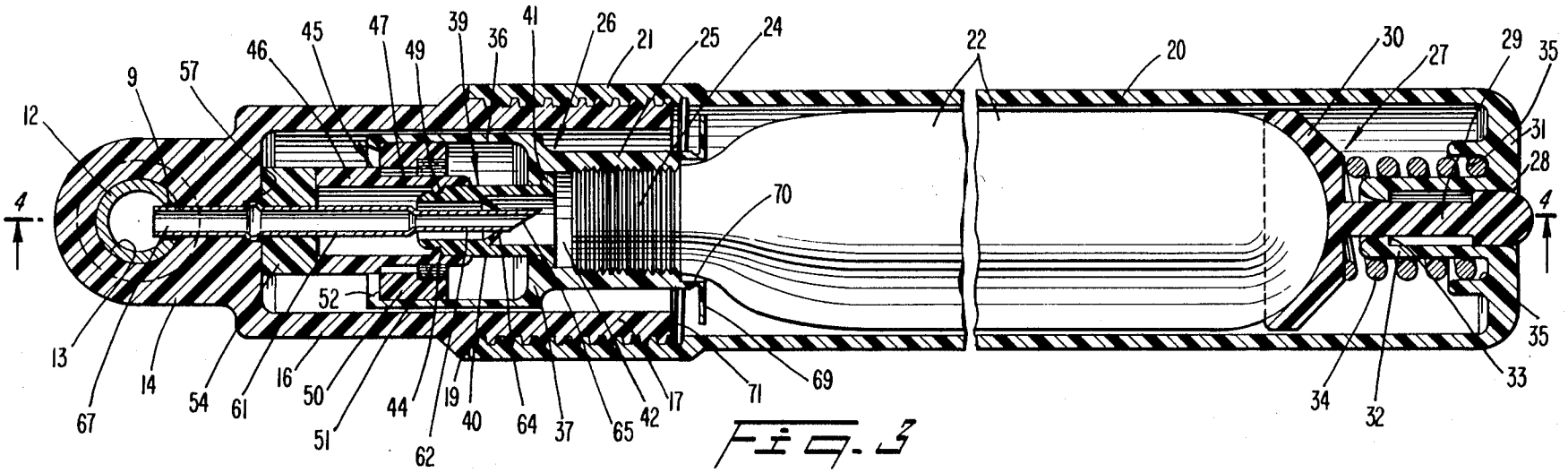
FIG. 3 is a view in longitudinal axial section through the inflator, the inflator being shown in cocked condition.
Figure 4:
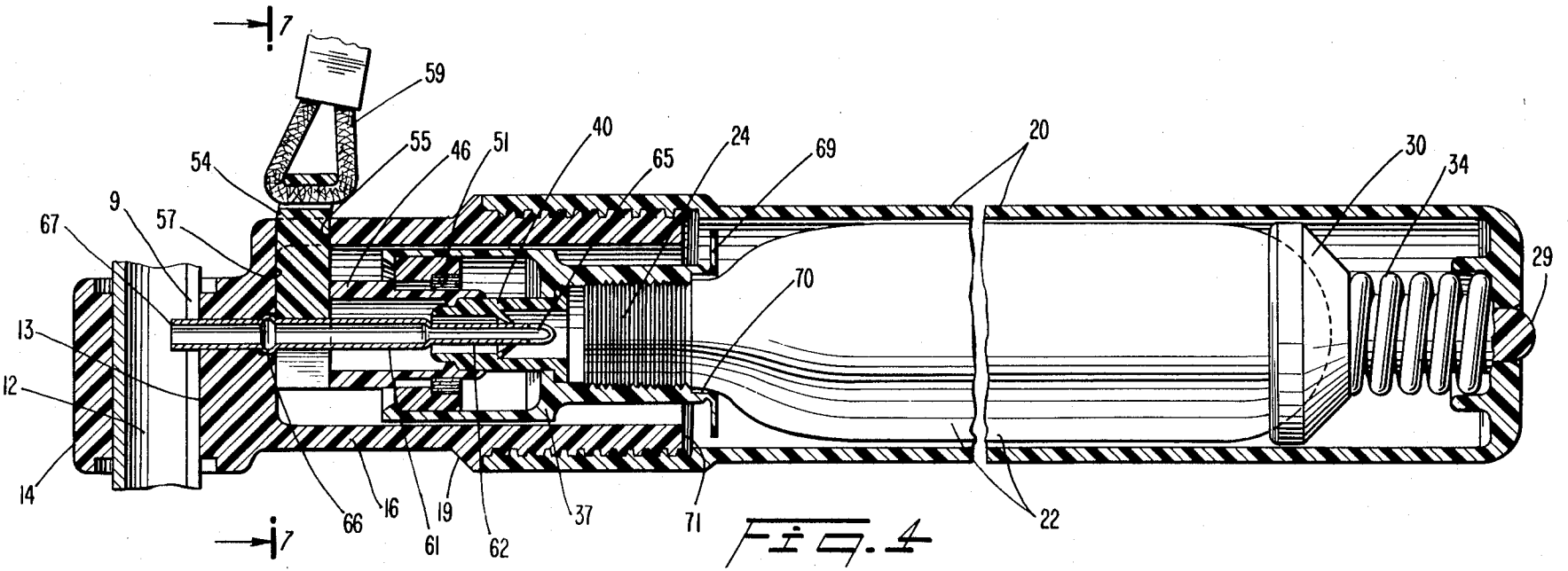
FIG. 4 is a view similar to FIG. 3 but with the sectioning plane displaced 90° about the axis of the inflator from that of FIG. 3.
Figure 5:
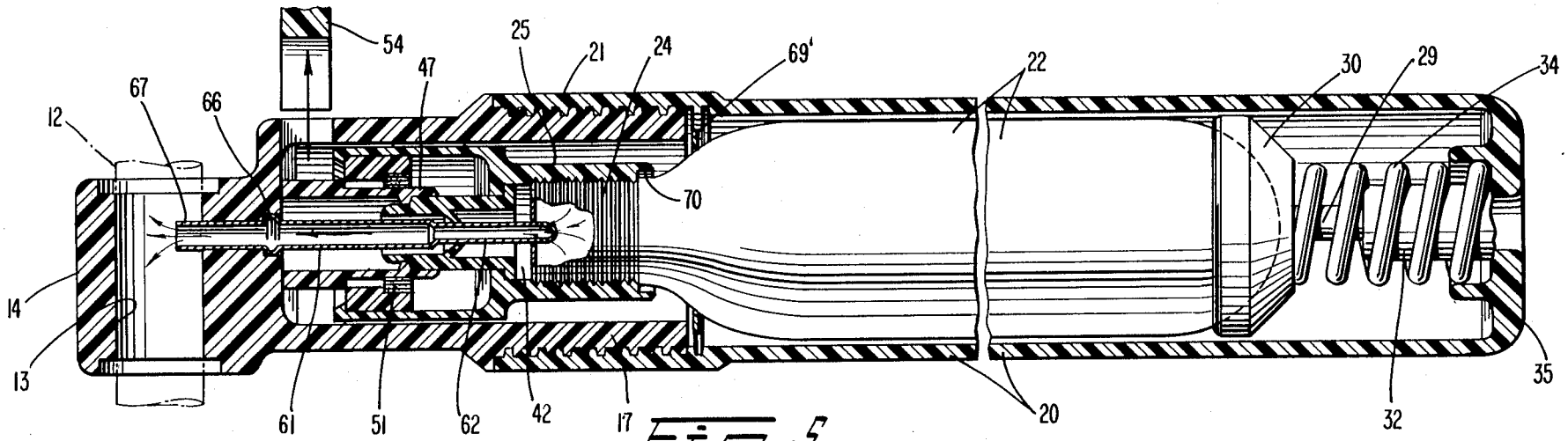
FIG. 5 is a view in longitudinal axial section through the inflator taken in a manner similar to FIG. 4, the inflator being shown in FIG. 5 in the condition which it assumes after having been manually operated or discharged.
Figure 6:
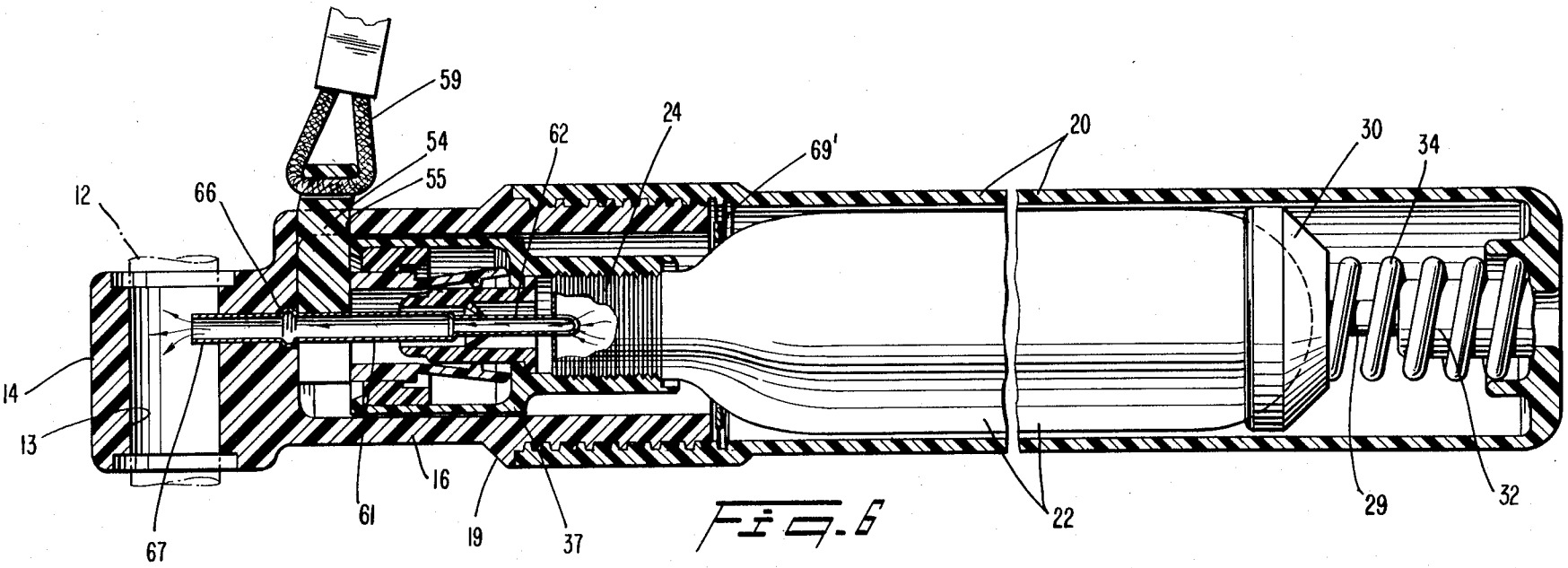
FIG. 6 is a view similar to FIG. 4 but with the inflator in the condition which it assumes after it has been automatically fired or discharged.

The second part of the housing is in the form of an elongated cup-shaped member 20 having an internally threaded forward end part 21 which mates with the externally threaded part 17, as shown. Housing part 20 has an internal diameter which somewhat exceeds the outer diameter of a $CO_2$ capsule 22 which is housed therewithin. As will appear hereinafter, when the inflator is cocked, as shown in FIGS. 3 and 4, the capsule 22 is strongly urged to move within the housing in the direction from right to left, but is held from movement in such direction by both a manually withdrawable abutment (employed in manual operation of the inflator), and by a water-sensitive latching means (employed in the automatic operation of the inflator). FIG. 5 shows the position of the parts after the inflator has been fired or discharged manually, whereas FIG. 6 shows the position of the parts after the inflator has been automatically operated or discharged.

Turning now to FIG. 3, it will be seen that the capsule 22 has externally threaded forward end or neck portion 24, threaded portion 24 of the capsule being threadedly received within an internally threaded rear portion 25 of a tubular member 26 which forms, in effect, an extension of the neck 24 of the capsule 22. It is the member 26, and/or the parts associated therewith, which maintain the capsule 22 from movement to the left when the inflator is cocked, and which permit the capsule to move to the left when the inflator is operated either manually or automatically to discharge the gaseous contents of the capsule 22 into the inflatable article.

The rear or right-hand end of the housing member 20 is provided with a plunger generally designated 27, which is reciprocable coaxially therewithin, the plunger having a central stem 29 and a head 30, the left-hand end surface of which is concave and mates with the rounded rear end surface of the capsule 22. The rear end wall 31 of the housing member 20 is somewhat thickened, and has a central guiding tube 32 extending forwardly therefrom, tube 32 serving to guide the stem 29 as it reciprocates. A coil compression spring 34 is disposed about the guiding tube 32, the rear end of the spring being disposed in a spring seat 35, and the forward end of the spring abutting the rear central surface of the head 30 of the plunger.

In the preferred embodiment shown, the part 20 of the housing and the lengths of the screw threads on the parts 17 and 21 are such that such threaded parts may be initially engaged without placing the coil compression spring 34 under any substantial stress, that is, compression. Thus the housing parts 16 and 20 can be preliminarly assembled with a $CO_2$ capsule 22 contained within them, and the inflator can be cocked by screwing the part 20 onto the part 16, thereby placing the spring 34 under compression, only when it is desired to cock the inflator or to prepare it for activation. It will be seen that the stem 29 has a shoulder 28 adjacent its rear end and that the guiding tube 32 has a shoulder 33 adjacent its forward end, engagement between such shoulders when the housing part 20 is removed from part 16 preventing the escape and possible loss of the plunger 27 and the spring 34. The stem 29 may be made of a distinctively colored plastic material so that the cocked condition (FIGS. 3 and 4) of the inflator can be readily determined visually from outside the inflator from the discharged condition thereof (FIGS. 5 and 6) in which the outer end of stem 29 lies inwardly of the outer end surface part 31 of the housing part 20.

The extension part or sleeve 26 has a forward larger diametered circular cylindrical sleeve part 36, part 36 being connected to part 25 at an annular junction 37 having a radially inwardly projecting annular flange integral therewith. An inner separate sleeve part 39 is disposed coaxially within parts 25 and 36 of member 26, part 39 having a radially outwardly extending flange 41 on its rear end, flange 41 being received within part 25 at its left-hand end. A washer 42 is disposed between the forward end of the threaded neck 24 of capsule 22 and the right-hand end surface of the flange 41, whereby to effect a gas-tight seal therebetween. Part 39 has a central hollow stem or sleeve 40 having an annular shoulder 44 adjacent its forward end. Shoulder 44 cooperates with a moisture sensitive latching means or bobbin 45 which is constructed in a manner which is generally similar to that of the latching means 61 disclosed in U.S. Pat. No. 4,260,075.

The bobbin or latching means 45 has a solid annular forward portion 46, the rear end part of which is divided to form a plurality of angularly spaced fingers 47. Each of the fingers 47 has an inwardly directed tooth 49 thereon, teeth 49 selectively cooperating with the shoulder 44 on the stem 40 of member 39. An annular insert 50 is disposed in a seat at the forward end of the member 36, there being a groove in the inner rear surface of the member 50 which receives a moisture destructible ring 51 which maintains the fingers 47 pressed radially inwardly until it is weakened by being subjected to moisture. As shown in FIGS. 3–6, incl., the annular insert 50 is prevented from escape in a forward direction from the member 36 by an annular abutment 52 on the forward end of such member 36.

MANUAL OPERATION

So long as the moisture destructible ring 51 remains intact and the fingers 49 are thus held in engagement with the shoulder 44, the parts 26, 39 and 46 function as extensions of the neck 24 of the capsule 22 and thus move therewith in the direction from right to left, thereby to permit the piercing of a frangible seal 23 at the forward end of the neck 24 of the capsule, when they are permitted to move to the left.

Figure 7:
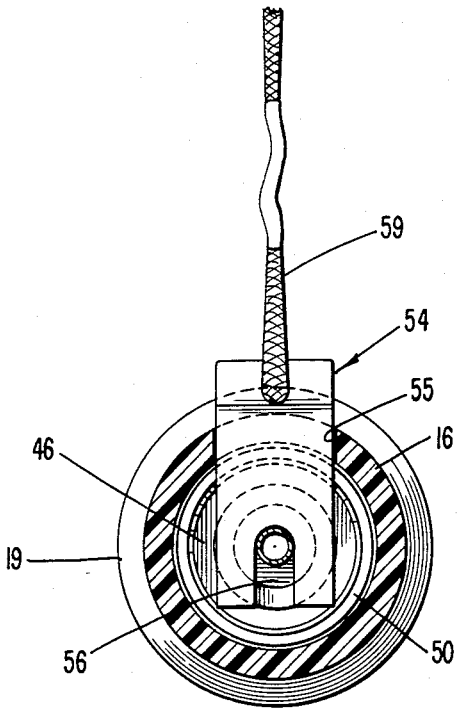
FIG. 7 is a view in transverse section through the inflator, the section being taken along the line 7—7 in FIG. 4.

As shown in FIGS. 3 and 4, wherein the inflator is shown in its cocked position, a laterally removable or withdrawable abutment 54, in the form of a yoke, as shown in FIG. 7, is interposed between the rear or inner wall 57 of FIG. 4 and the forward end surface of the member 46. The yoke or abutment 54 is slidable through an opening 55 provided in the side wall of the member 16. A slot 56 in the inner end of the abutment 54 receives the root of the hollow piercing pin 61 therewithin. The piercing pin has a rear portion 62 of reduced diameter, the rear end portion thereof being bevelled and sharpened as shown at 65. In order to provide a seal between the opening created by the end 65 of the piercing pin in the sealing means of the capsule and the interior of the piercing pin, there is provided a thin rearwardly inclined flexible frusto-conical seal 64 which surrounds the portion 62 of the piercing pin.

As shown in FIGS. 3–6, incl., the forward end of the piercing pin is secured at 66 to the fitting 14 on housing member 16. The forward end 67 of the piercing pin projects into the bore 13 in fitting 14, and functions as a key fitting within a slot 9 in the side wall of the stem 12, thereby to prevent the stem from rotation with respect to the fitting 14.

When it is desired to operate the cocked inflator manually, the yoke or abutment 54 is withdrawn laterally from it by pulling on a handle 60 affixed to the outer end of a lanyard 59, the inner end of the lanyard being secured to the yoke or abutment 54 as shown. This permits the $CO_2$ capsule 22, the part 26 affixed thereto, as well as the parts 39 and 46 to move to the left so that the left-hand end of the annular member now engages the inner end surface 57 of the fitting 14. When the parts have thus moved, the piercing end 65 of the piercing pin will have penetrated and made a hole through the sealing means 23 on the neck of the capsule, thereby allowing the contents thereof to escape into the stem 12 and thence into the inflatable part.

AUTOMATIC OPERATION

In this mode of operation, the abutement or yoke 54 remains in place in part 16 of the housing. Assuming that a pilot wearing a life jacket or a Mae West equipped with the inflator of the invention has ditched and is unable to operate the inflator manually, water will enter the portion 16 of the housing of the inflator and flow into contact with the moisture destructible ring 51. Thereupon the compression spring 34, acting through the plunger 27, the capsule 22, and the member 26 will thrust the fingers 47 of the member 46 apart, thereby allowing the member 20 to move into the annular member 46 in the direction from right to left. Thus the neck 24 of the capsule is brought toward the piercing pin 61,62 so that the sharpened end 65 thereof forms a hole within the sealing means 23. The gas within the capsule 22, as in manual operation, then flows into the piercing pin, through the stem 12, and into the inflatable article.

The embodiment of the inflator of the invention as shown herein incorporates means whereby it can readily be told whether or not the inflator has been operated, whether manually or automatically. Thus, as shown in FIGS. 3 and 4, the member 26 is initially supplied with a transversely extending ring 69 which is secured to the rear end of the member 25 by a frangible connection 70. The ring 69 has an outer diameter which somewhat exceeds the inner diameter of the portion 17 of the housing part 16, so that when the part 26 moves forwardly, that is, to the left, as shown in either FIGS. 5 or 6, the connection 70 breaks, thereby leaving a disconnected ring 69' which encircles the neck of the capsule 22. Thus one unscrewing the housing part 20 from the housing part 16 can readily tell that the inflator has been operated, both by the presence of a disconnecting ring 69' on the neck of the capsule 22, and also by the fact that the ring 69 has been broken away from the rear end of the portion 25 of the member 26.

As indicated in the drawings, the parts of the housing of the inflator as well as those of the latching mechanism for automatic operation and the removable abutment for manual operation are preferably made of strong shock resistant plastic material. Such material, for example, may be an acetal resin, such as that marketed by DuPont under the trademark "DELRIN".

Although the invention is illustrated and described with reference to one preferred embodiment thereof, it is to be expressly understood that it is in no way limited to the disclosure of such preferred embodiment but is capable of numerous modifications within the scope of the appened claims.

I claim:

1. An automatic inflator which inflates gas-inflatable articles by the release of compressed gas from a gas-containing capsule by the piercing of a sealing means on the capsule, comprising an elongated housing having first and second end portions, the housing receiving a compressed gas-containing capsule for longitudinal movement with respect thereto and with the sealing means on the capsule disposed adjacent the second end portion of the housing, a piercing pin mounted on the second end portion of the housing to confront the sealing means of a capsule mounted therein, resilient means at the first end portion of the housing for constantly urging the capsule longitudinally of the housing toward the second end portion thereof, a releasable blocking means adjacent the second end portion of the housing and interposed between the sealing means-containing end of the capsule and said end portion of the housing to hold the sealing means of the capsule spaced from the piercing pin, the blocking means including a water-sensitive means which when wet releases the blocking means so that the resilient means moves the capsule toward the piercing pin so that the sealing means of the capsule is pierced thereby, the blocking means comprising telescopically disposed inner and outer parts disposed with their axes aligned longitudinally of the housing, one of said inner and outer parts of the blocking means engaging the capsule and the other of said inner and outer parts of the blocking means being disposed in thrust transmitting relationship with the second end portion of the housing, and a supporting means interposed between the said other of said inner and outer parts of the blocking means and the second end portion of the housing.

2. An automatic inflator according to claim 1, wherein the housing has a first part including the first end portion, and a second end part including the second end portion, and means for demountably connecting the two parts of the housing together.

3. An automatic inflator according to claim 2, wherein the two parts of the housing are disposed in telescopic arrangement, and comprising a screw threaded connection between such two parts, the length of the screw threaded connection being such that the two parts of the housing may be initially engaged without placing the resilient means under any substantial stress.

4. An automatic inflator according to claim 1, wherein the supporting means is a member which is manually removable from the housing, whereby the capsule and the blocking means move together toward the second end portion of the housing so that the piercing pins pierces the sealing means of the capsule.

5. An automatic inflator according to claim 1, wherein the inner part of the blocking means is attached to the capsule and the outer part of the blocking means is disposed in thrust transmitting relationship with the second end portion of the housing.

6. An automatic inflator according to claim 5, wherein the capsule has an externally-threaded neck portion, and the inner part of the blocking means is attached to the threaded portion of the capsule.

7. An automatic inflator according to claim 5, wherein the inner part of the blocking means has a transverse surface thereon, and the outer part of the blocking means is in the form of a sleeve made up of a plurality of axially extending segments having teeth on the inner surface adapted releasably to engage the transverse surface on the inner part of the blocking means, the segments of the sleeve are mounted for being swung radially outwardly to free the teeth from engagement with the transverse surface, and a water-destructible ring is disposed around the segments to hold the teeth thereon in engagement with said transverse surface.

8. An automatic inflator according to claim 7, comprising means engaging the outer surface of the ring in locations between the segments of the sleeve to hold the ring in compression in the spans thereof between such means and successive segments of the sleeve.

9. In the combination of a gas-inflatable article having a hollow stem mounted on the article, and an inflator which inflates the article through the hollow stem by the release of compressed gas from a gas-containing capsule by the piercing of a sealing means on the capsule, said inflator having a body with means for receiving the hollow stem and effecting a seal therewith, means for holding a gas-containing capsule, means for holding a piercing pin in alignment with the sealing means on the capsule, and means for selectively moving the piercing pin and the capsule relatively toward each other whereby to pierce the capsule seal, the improvement wherein the piercing pin is in the form of a tube having a first, sharpened capsule seal-piercing end, the second, other end of the tubular piercing pin extending normal to and being directly connected to the hollow stem mounted on the inflatable article, and means to seal the exterior of piercing pin to the capsule.

10. The arrangement according to claim 9, wherein the second, other end of the piercing pin extends into a slot in the hollow stem, thereby functioning as a key to keep the stem from rotating with respect to the body of the inflator.

11. An automatic inflator which inflates gas-inflatable articles by the release of compressed gas from a gas-containing capsule by the piercing of a sealing means on the capsule, comprising an elongated housing having first and second end portions, the housing receiving a compressed gas-containing capsule for longitudinal movement with respect thereto and with the sealing means on the capsule disposed adjacent the second end portion of the housing, a piercing pin mounted on the second end portion of the housing to confront the sealing means of a capsule mounted therein, resilient means at the first end portion of the housing for constantly urging the capsule longitudinally of the housing toward the second end portion thereof, and a releasable blocking means adjacent the second end portion of the housing and interposed between the sealing means-containing end of the capsule and said second end portion of the housing to hold the sealing means of the capsule spaced from the piercing pin, the blocking means including a water-sensitive means which when wet releases the blocking means so that the resilient means moves the capsule toward the piercing pin so that the sealing means of the capsule is pierced, thereby, the blocking means comprising telescopically disposed inner and outer parts disposed with their axes aligned longitudinally of the housing, one of said inner and outer parts of the blocking means engaging the capsule and the other of said inner and outer parts of the blocking means being disposed in thrust transmitting relationship with the second end portion of the housing.

* * * * *